United States Patent [19]

Nonomaque et al.

[11] 3,989,328

[45] Nov. 2, 1976

[54] REFRIGERATOR CABINET CONSTRUCTION

[75] Inventors: Clyde Joseph Nonomaque; Vernon Paul Rolland, both of Fort Smith, Ark.

[73] Assignee: Whirlpool Corporation, Benton Harbor, Mich.

[22] Filed: May 2, 1975

[21] Appl. No.: 574,249

[52] U.S. Cl. ..... 312/214; 312/236; 264/45.1

[51] Int. Cl.[2] ..... A47B 81/00; F25B 11/00

[58] Field of Search ..... 312/214, 236; 264/45.1, 264/45.2, 46.1, 46.5

[56] References Cited

UNITED STATES PATENTS

| | | | |
|---|---|---|---|
| 1,925,271 | 9/1933 | Miller | 264/46.5 |
| 2,807,942 | 10/1957 | Dahlgren | 312/236 |
| 2,958,210 | 11/1960 | Rill, Jr. | 312/214 |
| 3,137,744 | 6/1964 | Burrus | 264/46.5 |
| 3,478,135 | 11/1969 | Randall | 264/45.2 |
| 3,489,477 | 1/1970 | Harder, Jr. | 312/214 |
| 3,512,323 | 5/1970 | Hupfer | 264/46.5 |
| 3,674,359 | 7/1972 | Crowe | 312/214 |
| 3,684,342 | 8/1972 | Jansen | 312/214 |
| 3,727,295 | 4/1973 | Gildemeister | 264/46.5 |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

A refrigeration appliance cabinet provided with an improved foam stop and insulation element at a front edge portion of the cabinet. The element may be formed of a rigid polyurethane foam to provide improved insulation characteristics and provide centering of the cabinet liner during the assembly of the cabinet construction.

14 Claims, 5 Drawing Figures

REFRIGERATOR CABINET CONSTRUCTION

BACKGROUND OF THE INVENTION

1. Field of the Invention

This invention relates to cabinet construction and in particular to refrigeration appliance cabinet construction.

2. Description of the Prior Art

In U.S. Letters Pat. No. 3,512,323 of Ronald K. Hupfer, which patent is owned by the assignee hereof, an insulated wall structure is shown wherein the cabinet wall structure includes an inner liner panel, an outer shell panel, and a body of foamed-in-place insulation therebetween. A sheet of fibrous material is extended across the space defined by the front edges of the panels to define a boundary of the foamed-in-place insulation and permit a removable installation of a breaker strip between the front panel edges.

The technique of foaming-in-place such refrigeration appliance cabinet insulation is disclosed in the Paul B. Burrus U.S. Letters Pat. No. 3,137,744. As shown therein, the insulation is formed in the space between the liner and shell panel by introduction of the foamable material into the top of the space with the front edges of the panels lowermost. The space between the front edges may be closed by fiberglass strips to provide a resilient section in which electrical conductors and refrigerant conduits may be provided.

In U.S. Letters Pat. No. 3,288,896 of Mervin E. Hendricks, a refrigerator cabinet is provided having resilient members 19 secured to the foamed side of the liner by suitable means, such as adhesive. A breaker strip 6 is mounted between the liner and shell panels to close the front of the space therebetween.

Howard S. Franck discloses, in his U.S. Letters Pat. No. 3,516,566, a foam stop formed of laminated fibrous layers, such as fiberglass or glass wool, and provided with an end section of wedge-shaped configuration causing the expanding foam to press an end part of the stop against the liner panel to delimit and stop the flow of the expanding foam.

Albert M. Lee et al, in United States Letters Pat. No. 3,402,520, disclose a panel with a foamed-in-place core utilizing resilient strips permitting excess gas to escape through vents in the frame. A portion of the strip is provided in the core unit to form a relatively high density stratum for reinforcing the panel and interlocking the core thereto.

In U.S. Letters Pat. No. 3,674,359 of William P. Crowe, a refrigerator cabinet is shown utilizing a fiberglass foam strip between the front edges of the liner and shell portions.

Robert A. Jansen, in U.S. Letters Pat. No. 3,684,342, shows a refrigerator cabinet construction utilizing a pervious foam stop strip having an open cell construction permitting egress of gas through the pores thereof during the foaming operation.

SUMMARY OF THE INVENTION

The present invention comprehends an improved refrigeration appliance cabinet construction wherein a strip of rigid foam is provided for closing the front opening between the inner liner and outer shell panels of the appliance cabinet.

The foam strip may be formed of rigid polyurethane or rigid expanded styrene to provide an improved insulation at the front edge of the cabinet structure.

The rigidity of the foam stop strip further permits the strip to serve as means for holding the liner centered in the inner cabinet shell panel during the assembly thereof. Thus, the present invention permits the elimination or reduction in the use of brackets for holding the liner in the desired centered relationship to the shell prior to the foaming-in-place of the insulation.

The rigidty of the present foam stop prevents collapse thereof during the foaming operation and, thus, permits a relatively high pressure foam formation providing improved foam construction in the insulating cabinet.

The rigid foam stop provides facilitated foaming-in-place operation with the cabinet arranged in the downwardly opening configuration as the improved foam stop effectively prevents leaks of the foam downwardly therethrough during the foaming operation.

The rigid foam stop can be provided with vent passages sized to be self-sealing during the foaming-in-place operation to provide facilitated foaming-in-place of insulation with the cabinet arranged in the upwardly facing configuration.

The foam stop of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
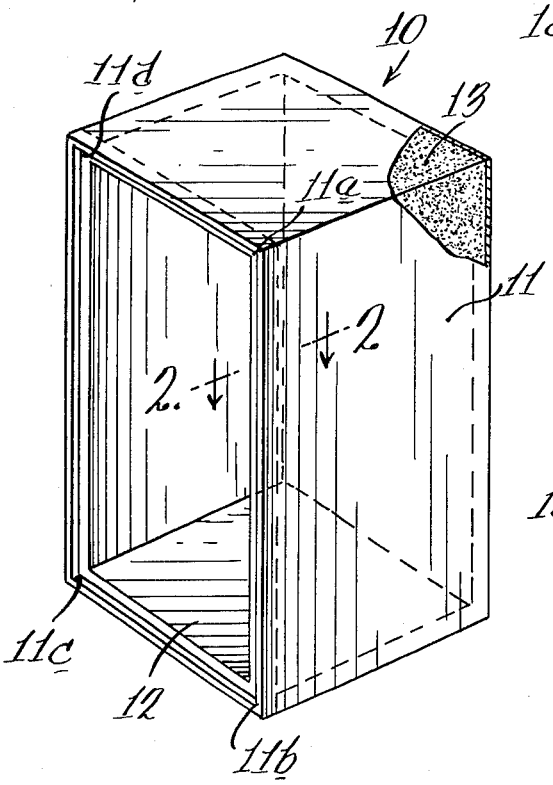
FIG. 1 is a perspective view with a portion broken away of a refrigeration appliance cabinet construction embodying the invention.
Figure 2:
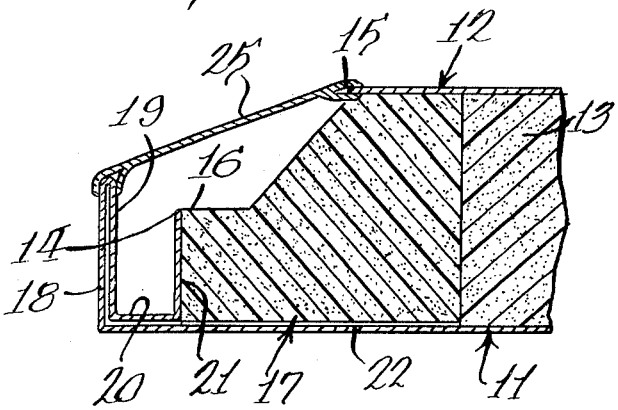
FIG. 2 is a fragmentary enlarged horizontal section thereof taken substantially along the line 2—2 of FIG. 1.

In the exemplary embodiment of the invention as disclosed in FIGS. 1 and 2 of the drawing, a refrigeration appliance cabinet construction generally designated 10 is shown to comprise an outer panel defining a shell 11, an inner panel defining a liner 12, and a body of foamed-in-place insulation 13 therebetween. In illustrating the invention, the cabinet construction is shown to comprise a conventional refrigerator cabinet, it being understood that the invention is adapted for use in forming any desired insulated cabinet wherein insulation is foamed-in-place between the inner and outer panels defining an open edge portion.

In the present invention, the front edge 14 of the shell panel and the front edge 15 of the liner panel cooperatively define an opening 16 at the front of the cabinet. Opening 16 herein is closed by an improved foam stop generally designated 17 permitting the foaming-in-place of the insulation 13 with the liner 12 centered within the shell 11. Foam stop 17 assists in the centering of the liner relative to the shell as well as defining means for preventing leakage of foam insulation outwardly through opening 16 during the foaming process.

A conventional heat break trim illustrated at 25 is provided to provide a finished appearance after assembly of the refrigerator is complete.

As illustrated in FIG. 2, the front portion of shell 11 may be defined by an inturned flange 18, a return flange 19, a short leg 20 extending parallel to shell 11, and a second inturned flange 21 defining, at its distal end, edge 14. A rigid foam stop strip 17 is mounted between panels 11 and 12 and may be secured therebetween as by adhesive 22 securing the strip to the shell panel 11. As shown in FIG. 2, the strip 17 is caused to have a preselected size suitable to center the liner panel 12 in the shell panel 11 to provide a telescoped association thereof, as illustrated in FIG. 1, with the space between the shell and liner panels being maintained accurately for improved insulation of the cabinet by the foamed-in-place insulation 13.

Figure 3:
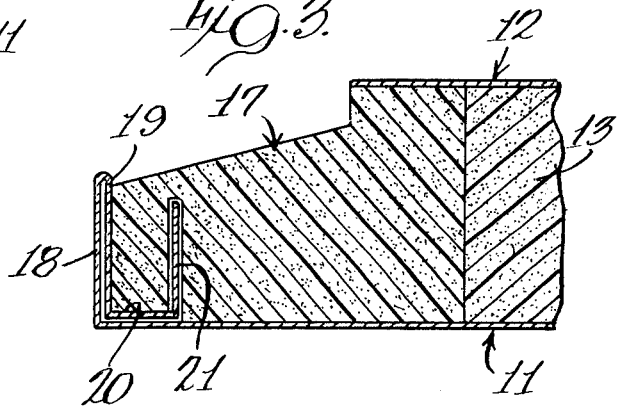
FIG. 3 is a fragmentary horizontal section similar to that of FIG. 2 but showing a modified form of the invention.

The strip 17 may be retained to the shell 11 by mechanical securing means, as illustrated in FIG. 3 by engaging the second inturned flange 21 thereby being secured between flanges 19 and 21. The strip becomes bonded to the foamed insulation 13 during the foaming installation and, thus, the securing means is provided primarily to maintain the strip in position during the assembly of the liner with the shell, and during the foaming operation. Alternate mechanical securing means such as suitable retaining clips or fasteners could likewise be used.

Strip 17 herein is preferably formed of a rigid material, such as rigid polyurethane foam, which has been found to provide a superior insulation at the front edge opening 16. The strip may thus have a K-factor substantially the equal to that of the foamed-in-place insulation, thus providing a substantial improvement over the conventional cabinet constructions wherein flexible polyurethane foam and fiberglass materials are utilized as the foam stop material. It is to be realized that other rigid insulating materials can be used but those with K-factors in the range of foamed-in-place insulation are preferred.

As indicated above, the use of the rigid foam stop eliminates or reduces the need for brackets and the like in maintaining the liner centered relative to the shell during the foaming-in-place operation and, thus, further simplifies and reduces the cost of the cabinet construction.

Still further, the rigidity of the foam has been found to effectively prevent collapsing or shifting of the foam stop element during the foaming operation notwithstanding relatively high pressure resulting from the foaming operation.

The improved rigid foam stop permits substantially trouble-free, downwardly facing foamed-in-place provision of the insulation 13 thereby further facilitating and reducing the cost of the cabinet construction.

The strip 17 may be molded to have the desired configuration and the transverse dimensions of the strip may be accurately preselected to facilitate insertion of the liner 12 therethrough while yet effectively accurately centering the liner in the shell and optimally filling the space 16 between the liner and shell with optimum insulation to minimize heat leakage into the refrigerator storage space. Alternatively, the strip may be cut from sheets of rigid polyurethane foam, and again, suitable accuracy in the cutting may be effected to provide the desired centering and foam-leakage functioning of the strip as discussed above. The strip may be continuous around the four sides of the cabinet.

Alternatively, the strip may be discontinuous and fitted at the four corners 11*a*, 11*b*, 11*c*, and 11*d* of the cabinet.

Figure 4:
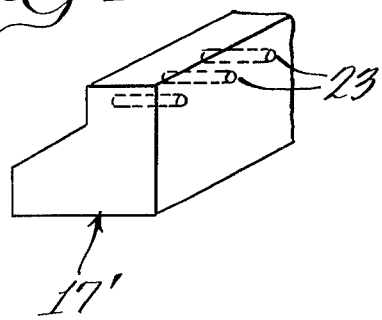
FIG. 4 is a perspective view of an alternate foam stop element.
Figure 5:
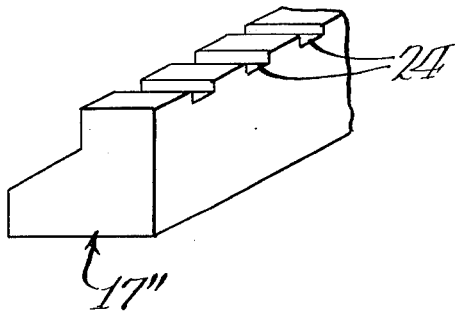
FIG. 5 is a perspective view of yet another alternate foam stop element.

FIG. 4 illustrates an alternate foam stop 17′ which is provided with a plurality of vent passages 23. The vent passages 23 comprise holes that are sized to be self-sealing with foamed-in-place insulation during the foaming operation. FIG. 5 illustrates yet another alternate foam stop 17″ which is provided with a plurality of vent passages 24 in the form of notches that are sized and shaped to be self-sealing with foamed-in-place insulation. The alternate foam stops 17′ and 17″ are intended for use when the cabinet is foamed-in-place with the cabinet arranged in the upwardly facing position. The vent passages permit gases evolved in the foaming operation to escape from the insulation space as the foam rises in the insulation space between the liner and cabinet shell. When the foam rises to the foam stop 17′ or 17″, the passages self-seal as by being plugged with the rising foam. The passages, 23 and 24, in the foam stops 17′ and 17″ may be formed at the time the respective foam stop elements are formed as by molding. Alternately, the passages may be suitably mechanically formed subsequent to formation of the foam stop elements.

Foam stop means 17 is extremely simple and economical of construction while yet providing the desirable features discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration appliance cabinet having an outer shell and an inner liner cooperatively defining an insulation space therebetween having a front opening, means for centering said liner in accurately spaced relationship within said cabinet shell comprising a strip of rigid foam effectively closing said front opening, and foamed-in-place insulation in said insulation space, said strip further comprising foam stop means for preventing passage of foam outwardly through said front opening during foaming-in-place of said insulation.

2. The cabinet structure of claim 1 wherein said rigid foam strip has a "K" factor substantially equal to that of said insulation.

3. The cabinet structure of claim 1 wherein said cabinet shell includes an inturned flange at said front opening and outwardly retaining said rigid foam strip.

4. The cabinet structure of claim 1 wherein adhesive means are provided for holding said rigid foam strip to said cabinet shell.

5. The cabinet structure of claim 1 wherein said cabinet shell includes first and second inturned flanges overlying said front opening and said rigid foam strip embraces one of said flanges and is retained in said cabinet by means of the interfitting relationship of said foam strip and said flanges.

6. The cabinet structure of claim 1 wherein said cabinet defines upper and lower corners and said rigid foam strip is discontinuous at said corners.

7. The cabinet structure of claim 1 wherein said rigid foam strip is formed of polyurethane.

8. The cabinet structure of claim 1 wherein means are provided on said cabinet shell for preventing movement of said rigid foam strip outwardly from said front opening.

9. The cabinet structure of claim 1 wherein said rigid foam strip defines a planar outer surface confronting said cabinet shell.

10. The cabinet structure of claim 1 wherein said rigid foam strip defines a planar inner surface confronting said liner.

11. The cabinet structure of claim 1 wherein said rigid foam strip includes a plurality of passages for venting gas from said insulation space during foaming when said foaming-in-place of said insulation is performed with said cabinet front opening disposed upward.

12. The cabinet structure of claim 11 wherein said rigid foam strip passages are sized to be self-sealing in the foaming-in-place operation.

13. The cabinet structure of claim 11 wherein said passages comprise notches in the inner surface of the foam strip adjacent said liner.

14. In a refrigeration appliance cabinet having an outer shell and an inner liner cooperatively defining an insulation space therebetween having a front opening, first and second spaced inturned flanges overlying said front opening, said first flange being located at the front edge of said shell and said second flange being spaced rearwardly thereof, means for centering said liner in accurately spaced relationship within said cabinet shell comprising a strip of rigid foam retained in said insulation space against outward movement by said second flange and effectively closing said front opening, and foamed-in-place insulation in said insulation space, said strip further comprising foam stop means for preventing passage of foam outwardly through said front opening during foaming-in-place of said insulation.

* * * * *